US008141396B1

(12) United States Patent
Yang

(10) Patent No.: US 8,141,396 B1
(45) Date of Patent: Mar. 27, 2012

(54) LOCK BOX ASSEMBLY

(76) Inventor: Yao Kun Yang, Changhua County (TW)

( * ) Notice: Subject to any disclaimer, the term of this patent is extended or adjusted under 35 U.S.C. 154(b) by 46 days.

(21) Appl. No.: 12/879,010

(22) Filed: Sep. 10, 2010

(51) Int. Cl.
*E05B 67/38* (2006.01)

(52) U.S. Cl. ..... 70/56; 70/55; 70/63; 70/333 A

(58) Field of Classification Search ..... 70/54–56, 70/63, 158, 333 A
See application file for complete search history.

(56) References Cited

U.S. PATENT DOCUMENTS

| | | | | |
|---|---|---|---|---|
| 5,003,795 | A * | 4/1991 | Hoke | 70/55 |
| 5,046,339 | A * | 9/1991 | Krell | 70/55 |
| 5,638,707 | A * | 6/1997 | Gould | 70/56 |
| D436,016 | S * | 1/2001 | Gould | D8/346 |
| 6,192,721 | B1 * | 2/2001 | Monteleone | 70/55 |
| 6,526,786 | B1 * | 3/2003 | Kayoda | 70/56 |
| 7,520,151 | B1 * | 4/2009 | Harmon | 70/56 |
| 7,540,175 | B2 * | 6/2009 | Kalous et al. | 70/63 |
| 2004/0226325 | A1 * | 11/2004 | Ling | 70/63 |
| 2009/0095036 | A1 * | 4/2009 | Ng et al. | 70/63 |
| 2011/0100074 | A1 * | 5/2011 | Meekma et al. | 70/63 |

* cited by examiner

*Primary Examiner* — Lloyd Gall
*Assistant Examiner* — Christopher Boswell

(57) ABSTRACT

A lock box assembly includes a lock box which includes a first casing and a second casing pivotally coupled to the first casing. The first casing has a combination lock disposed thereon. A protective shell is coveringly and detachably assembled with the first casing. The protective shell includes a cover panel shielding the first casing. A plurality of side panels extend from the cover panel for enclosingly forming a receiving space adapted for accommodating the first casing. At least one buckle is formed on the plurality of side panels. The cover panel has an opening defined therein and corresponds to the combination lock of the first casing. A lid is pivotally hinged to an edge of the opening for selectively shielding the opening. The protective shell and the lid protectively prevents the first casing the combination lock from exposing to weathering.

4 Claims, 6 Drawing Sheets

LOCK BOX ASSEMBLY

BACKGROUND OF THE INVENTION

1. Field of the Invention

The present invention relates to lock boxes, and more particularly to a lock box assembly which has a protective shell for preventing the lock box from exposing to weathering such that the usage life of the lock box is prolonged.

2. Description of Related Art

Lock boxes are widely used in many households for key retaining purposes. A conventional lock box comprises a body adapted for retaining key. A door or a lid movably engages with the body for shielding the body such that the key retained in the body is not exposed to the environment. A lock assembly is mounted in the body. The lock assembly has a key insertion hole defined therein. A key is inserted into the key insertion and is rotated in two opposite directions to lock/unlock the door/lid to the body.

Despite the effect it provides, the conventional lock box has the following drawbacks: first of all, the conventional lock box is locked/unlocked by the key to provide a locking effect, when the key is lost, it could be very bothersome to find ways to unlock the lock box.

Secondly, lock boxes are often exposed to weathering, such that their usage life is greatly shortened, or become very difficult to use upon a relative short period of time.

Furthermore, outer surfaces of the lock boxes are usually coated with paints for aesthetical purposes. When the lock boxes are scratched or hit by an external force, the paints may peel off and ruining the overall aesthetical appearance; structures of the lock assembly may also be damaged The present invention has arisen to obviate/mitigate the disadvantages of the conventional locking devices.

SUMMARY OF THE INVENTION

The present invention relates to a lock box assembly comprises a lock box which includes a first casing and a second casing pivotally coupled to the first casing such that the first casing is covered/uncovered by pivotally flipping the second casing. The first casing has a combination lock disposed thereon. A protective shell is coveringly and detachably assembled with the first casing. The protective shell is made of elastic material. The protective shell includes a cover panel shielding the first casing. A plurality of side panels extend from the cover panel for enclosingly forming a receiving space adapted for accommodating the first casing. Three buckles are formed on the plurality of side panels for buckling the protective shell with the first casing. Each buckle inwardly extend from a ridge of a corresponding side panel for detachably engaging with an edge of the first casing. The cover panel has an opening defined therein and corresponds to the combination lock of the first casing.

A lid is pivotally hinged to an edge of the opening for selectively shielding the opening such that the combination lock is selectively prevented from exposing. A buckle plate is disposed on a distal end of the lid which is adapted for allowing a user to pivotally flip the lid via the buckle plate to shield/unshield the opening of the first casing. The buckle plate has a protrusion formed on one end thereof for selectively engaging with the edge of the opening.

When the combination lock is activated, the second casing is refrained from pivotally flipping opened relative to the first casing; the protective shell and the lid protectively prevents the first casing the combination lock from exposing to weathering.

The present invention will become more obvious from the following description when taken in connection with the accompanying drawings which show, for purposes of illustration only, a preferred embodiment in accordance with the present invention.

DETAILED DESCRIPTION OF THE INVENTION

Figure 1:
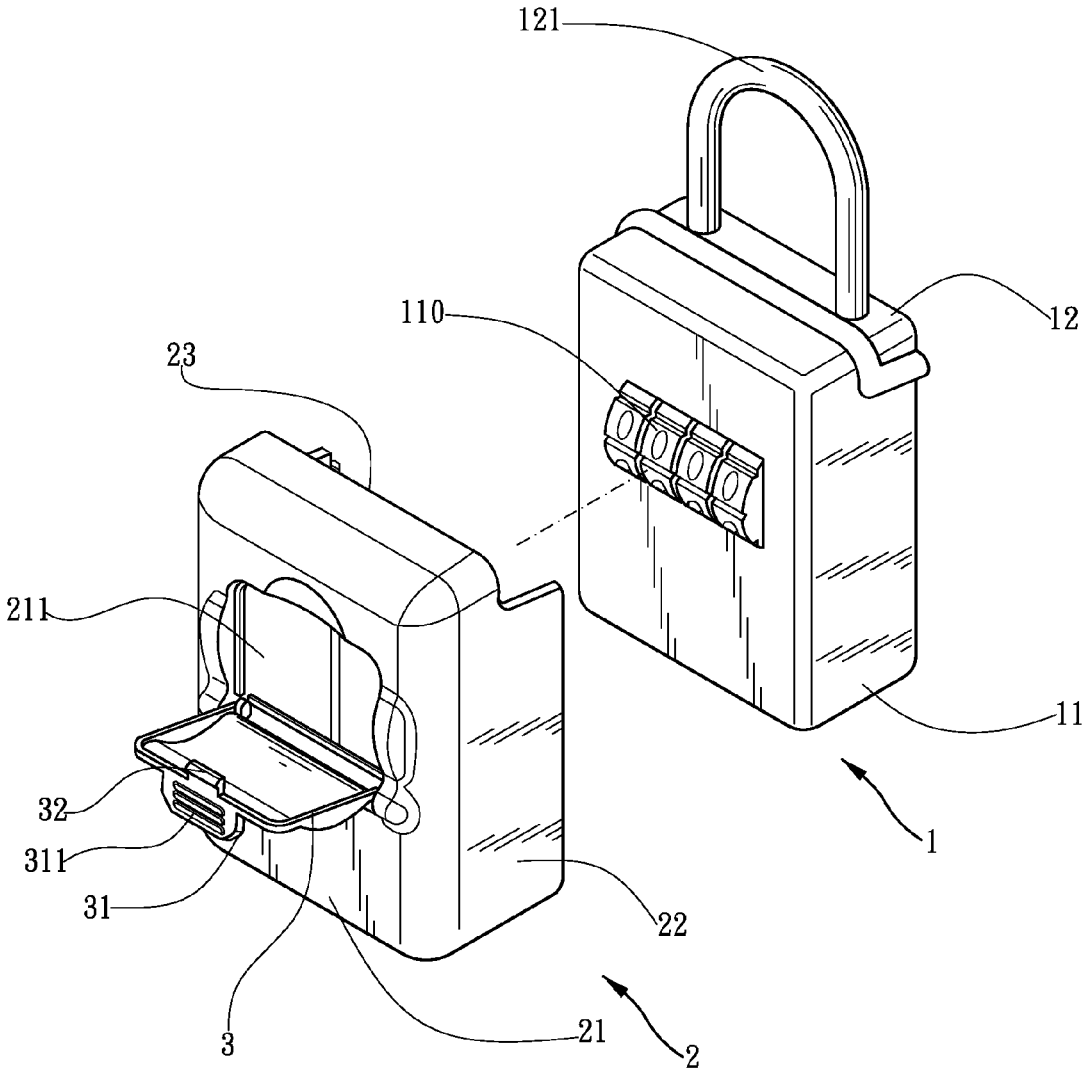
FIG. 1 is an exploded perspective view of the lock box assembly in accordance with the present invention.
Figure 2:
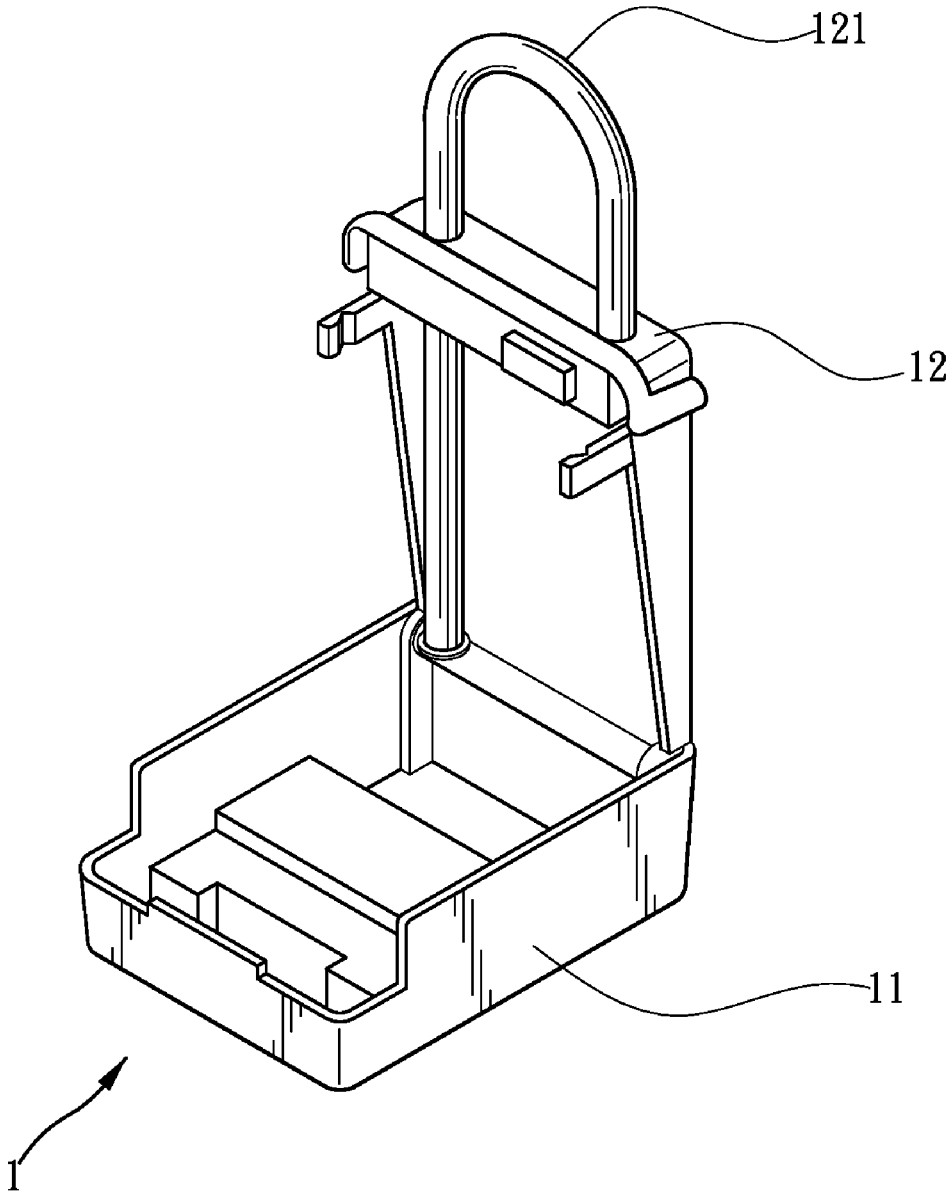
FIG. 2 is a perspective view of a lock box of the lock box assembly in accordance with the present invention.

Referring to the drawings and initially to FIGS. 1-6, a lock box assembly in accordance with the present invention comprises a lock box 1 which is adapted for storing small items such as keys (not shown). The lock box 1 includes a first casing 11 and a second casing 12 pivotally coupled to the first casing 11 such that the first casing 11 is covered/uncovered by pivotally flipping the second casing 12. The first casing 11 has a combination lock 110 disposed thereon. The combination lock 110 has four dial buttons (not numbered) for providing a locking effect. In the preferred embodiment, a generally U-shaped shackle 121 is mounted to the second casing 12 such that the lock box 1 is able to be suspendedly hanging on a door knob, cabinet handle . . . etc via the shackle 121.

Figure 3:
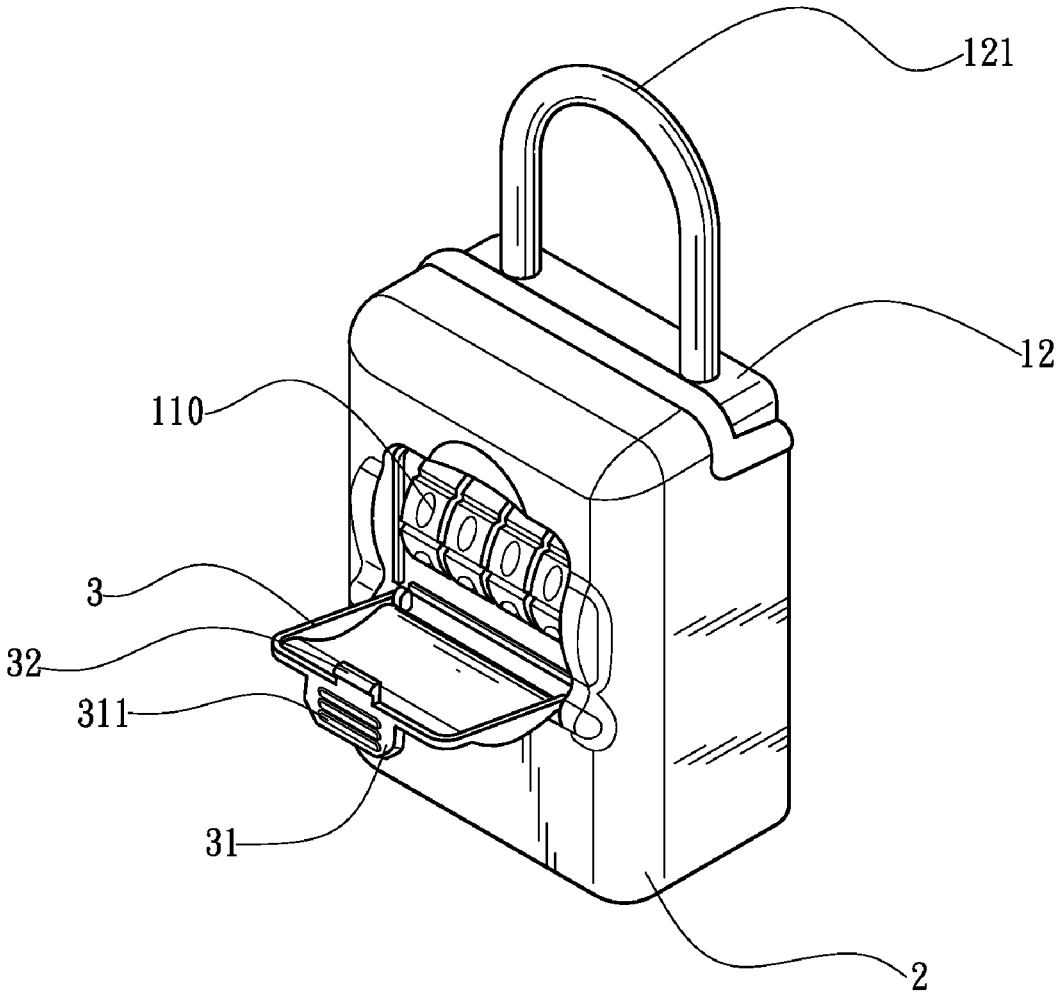
FIG. 3 is an assembled perspective view of the lock box assembly in accordance with the present invention, wherein a lid is.
Figure 4:
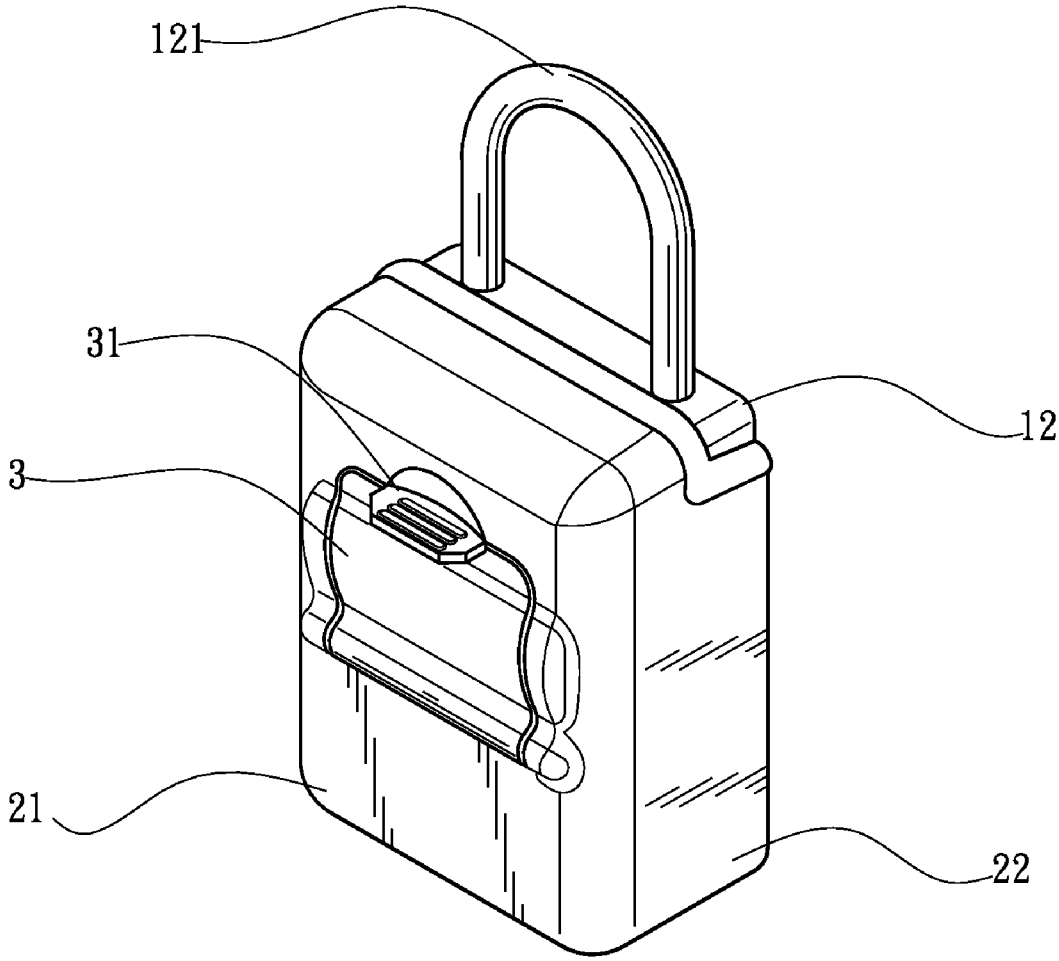
FIG. 4 is another assembled perspective view of the lock box assembly in accordance with the present invention; wherein the lid is.
Figure 5:
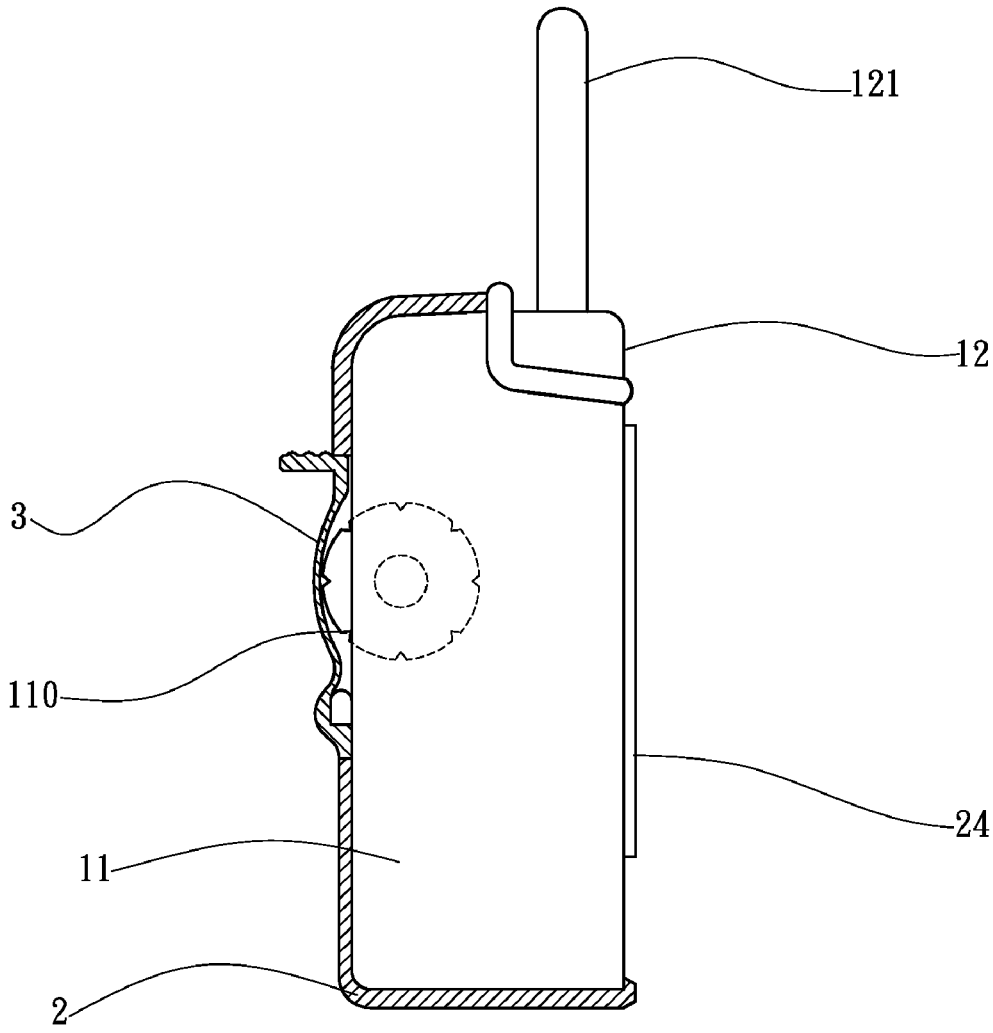
FIG. 5 is a cross-sectional view of the lock box assembly in accordance with the present invention.
Figure 6:
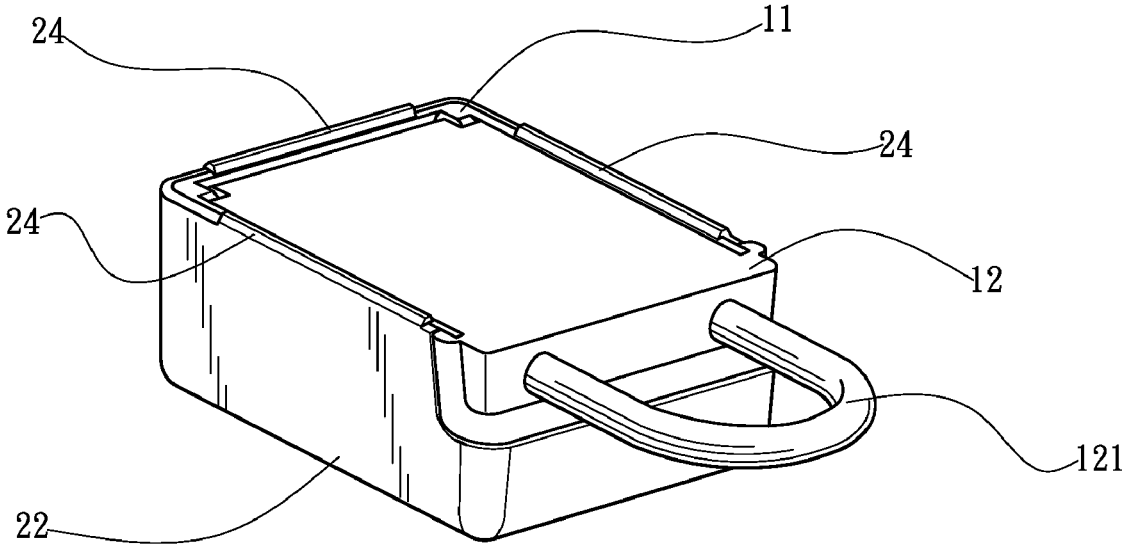
FIG. 6 is an assembled perspective view of the lock box assembly in accordance with the present invention showing the buckles buckling with the first casing.

A protective shell 2 which is integrally made of elastic material is detachably assembled with the first casing 11. The protective shell 2 includes a cover panel 21 shielding the first casing 11. The cover panel 21 has a substantially rectangular shape for corresponding to the first casing 11. Four side panels 22 respectively extend from the cover panel 21 for enclosingly forming a receiving space 23 which is adapted for accommodating the first casing 11. Three buckles 24 are formed on the side panels 22 for buckling the protective shell 2 with the first casing 11. Each buckle 24 inwardly extends from a ridge of a corresponding side panel 22 for detachably engaging with an edge of the first casing 11. Each buckle 24 is elongated shaped for providing a better securing effect. The cover panel 21 has an opening 211 defined therein and corresponding to the combination lock 110 of the first casing 11. The opening 211 is generally rectangular shaped for corresponding to the combination lock 110. Therefore, when the protective shell 2 is assembled with the first casing 11, the combination lock 110 is exposed, such that a user can operate the combination lock 110 easily without removing the protective shell 2 from the first casing 11. A lid 3 is pivotally mounted to an edge of the opening 211 for selectively shielding the opening 211 such that the combination lock 110 is selectively prevented from exposing (as shown in FIGS. 4-5). A buckle plate 31 is disposed on a distal end of the lid 3 and is adapted for allowing a user to pivotally flipping the lid 3 via the buckle plate 31 to shield or unshield the opening 211 of the first casing 11. The buckle plate 31 has a protrusion 32 formed on one end thereof for selectively and detachably engaging with the edge of the opening 211. When the lid 3 is pivotally flipped to shield the opening 211 of the first casing 11, the protrusion 32 engages with the first casing 11 for retaining the lid 3 such that the opening 211 is remained shielded. As shown in FIGS. 1, 3-4, a plurality of elongated-shaped anti-slip members 32 are disposed on the buckle plate 31 for providing an anti-slip effect such that the user is able to flip the lid 3 via the buckle plate 31 easily and conveniently.

When the combination lock 110 is activated, the second casing 12 is refrained from pivotally flipping opened relative to the first casing 11. The protective shell 2 and the lid 3 protectively prevents the first casing 11 the combination lock 110 unit from exposing to weathering.

In view of the above descriptions, it can be concluded that the lock box 1 assembly in accordance with the present invention has the following advantages:

First of all, the protective shell 2 assembled with the first casing 11 covers up most of the lock box 1, such that the lock box 1 is not exposed environments, hence prevents the lock box 1 from weathering. A usage life of the lock box 1 is prolonged.

Secondly, the protective shell 2 prevents the lock box 1 from being scratched, such that an aesthetical appearance of the lock box 1 is maintained.

Moreover, the protective shell 2 is made of elastic material, therefore, when the lock box 1 is hit by an external force, the protective shell 2 provides a shock-absorbing effect, preventing the lock box 1 (especially the combination lock 110 disposed on the first casing 11 of the lock box 1) from being damaged.

Although the invention has been explained in relations to its preferred embodiment, it is to be understood that many other possible modifications and variations can be made without departing from the spirit and scope of the invention as hereinafter claimed.

What is claimed is:

1. A lock box assembly, comprising:

a lock box including a first casing and a second casing pivotally coupled to the first casing such that the first casing is covered/uncovered by pivotally flipping the second casing, the first casing having a combination lock disposed thereon;

a protective shell coveringly and detachably assembled with the first casing, the protective shell including a cover panel shielding the first casing, a plurality of side panels extending from the cover panel for enclosingly forming a receiving space adapted for accommodating the first casing; at least one hook formed on the plurality of side panels for buckling the protective shell with the first casing; the cover panel having an opening defined therein and corresponding to the combination lock of the first casing; and a lid pivotally hinged to an edge of the opening for selectively shielding the opening such that the combination lock is selectively prevented from exposing;

wherein when the combination lock is activated, the second casing is refrained from pivotally flipping opened relative to the first casing; the protective shell and the lid protectively prevents the first casing the combination lock from exposing to weathering.

2. The lock box assembly as claimed in claim 1, wherein the at least one hook is three hooks, each hook inwardly extending from a ridge of an corresponding side panel for detachably engaging with an edge of the first casing.

3. The lock box assembly as claimed in claim 1 further comprising a hook plate disposed on a distal end of the lid adapted for allowing a user to pivotally flip the lid via the hook plate to shield/unshield the opening of the first casing, the hook plate having a protrusion formed on one end thereof for selectively engaging with the edge of opening.

4. The lock box assembly as claimed in claim 1, wherein the protective shell is made of elastic material.

* * * * *